United States Patent [19]

Weeks et al.

[11] 3,981,475

[45] Sept. 21, 1976

[54] SHELF ANCHORING CLIP

[75] Inventors: Kenneth D. Weeks, Valdese; Ronald W. Scoggin, Morganton, both of N.C.

[73] Assignee: Champion International Corporation, Stamford, Conn.

[22] Filed: Feb. 21, 1975

[21] Appl. No.: 551,661

[52] U.S. Cl. ..... 248/500; 248/25

[51] Int. Cl.[2] ..... F16M 1/00

[58] Field of Search ..... 105/463, 464, 465; 269/134, 138, 229, 231, 235, 236; 248/25, 235, 239, 250, 500–510; 403/409

[56] References Cited

UNITED STATES PATENTS

| | | | |
|---|---|---|---|
| 944,725 | 12/1909 | Ferguson | 85/41 |
| 1,546,721 | 7/1925 | Davis | 269/231 X |
| 2,095,037 | 10/1937 | Reintjes | 269/235 X |
| 2,489,477 | 11/1949 | Brecher | 248/507 X |
| 2,908,474 | 10/1959 | Chiarito | 248/507 |
| 2,917,267 | 12/1959 | Riddle | 248/507 |
| 2,972,497 | 2/1961 | Romine | 248/25 X |
| 3,072,423 | 1/1963 | Charlton | 85/1 R X |
| 3,362,672 | 1/1968 | Wigam | 248/507 |
| 3,471,112 | 10/1969 | MacDonald et al. | 248/250 X |
| 3,702,560 | 11/1972 | Weidel | 248/25 X |
| 3,870,266 | 3/1975 | MacDonald | 248/235 |

FOREIGN PATENTS OR APPLICATIONS

| | | | |
|---|---|---|---|
| 1,327,880 | 4/1963 | France | 248/239 |
| 1,132,060 | 6/1962 | Germany | 269/138 |
| 812,693 | 4/1959 | United Kingdom | 269/229 |

*Primary Examiner*—Lawrence J. Staab
*Attorney, Agent, or Firm*—Evelyn M. Sommer

[57] ABSTRACT

Loose shelves are anchored against the bottom wall of a cabinet for purpose of shipping. A clip has a flat side enabling it to be slipped, while in contact with the upper surface of the stacked shelves, into a bore in a side wall of the cabinet which bore is substantially tangent to the top of said stack. Thereupon a screwdriver slot in the end of the clip is used to rotate the clip 180° positioning a flange segment on the clip between the shelves and said side wall of the cabinet. The clip has a cylindrical portion on one side of said flange segment for insertion in said bore while on the other side of said flange segment the clip flares to provide a camming portion which locks it in place upon said rotation. A plurality of said clips are used at opposite ends of said shelves. Reversal of the installation procedure enables the clips to be removed and the shelves to be freed.

4 Claims, 8 Drawing Figures

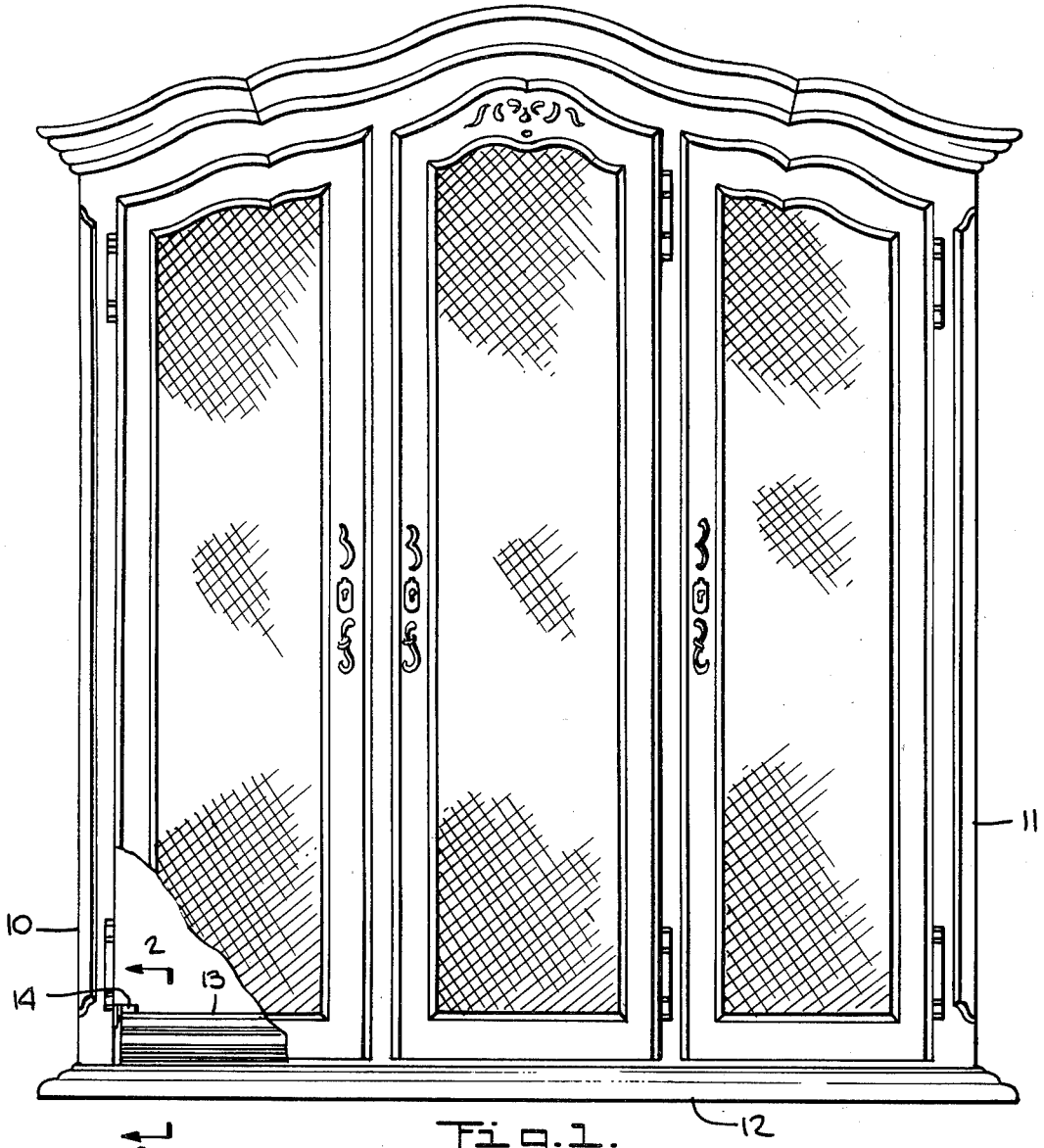
Fig. 1.
Fig. 2.
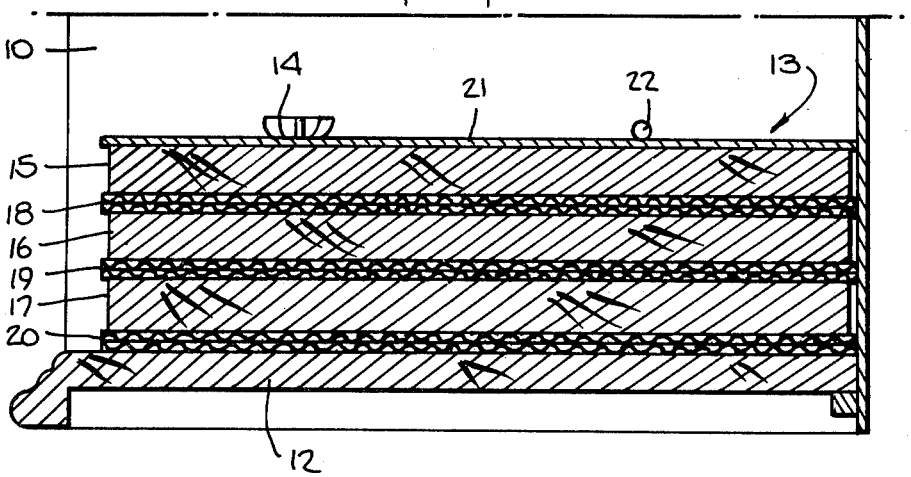

SHELF ANCHORING CLIP

The present invention relates to a clip and, more particularly, to a fastening device for use as a shipping aid.

Certain cabinets with removable or adjustable shelves are shipped with the shelves disposed in a stacked assembly secured to a bottom or stationary wall of the cabinet. For example, one prior method has been to stack the shelves at the bottom of the cabinet with appropriate protective material interleaved therebetween. To secure the stacked assembly in place, strips of lumber were disposed across the top of the stack and clips were inserted into the side panels of the cabinet whereupon such clips were attached by screws to the ends of said lumber strips. While such method has proven effective in protecting the shelves during shipment, it is inconvenient both during the packing and unpacking stage.

The present invention has for an object the provision of an inexpensive clip which is conveniently and rapidly installable as well as removable for more efficient packing.

In accordance with the subject invention, such clip is provided for anchoring loose shelves within a cabinet during shipping and comprises an elongated body having at one end a cylindrical portion for insertion in a bore in a side panel of the cabinet. At the other end of the body there is provided a camming portion with a surface on its side for exerting pressure against the adjacent surface of a stacked assembly of said shelves. In addition, a segment of an annular flange is disposed intermediate the ends of said body in a plane substantially normal to the longitudinal axis of said body for disposition between said side panel and an end of at least one shelf.

The invention will be better understood after reading the following detailed description of the presently preferred embodiment thereof with reference to the appended drawings wherein:

FIG. 1 is an elevational view of a typical cabinet with a portion at the lower corner broken away to reveal the stacked shelves ready for shipment;

FIG. 2 is a fragmentary transverse sectional view of the cabinet taken along the line 2—2 in FIG. 1;

The same reference numerals are employed throughout the various figures of the drawings to designate the same or similar parts.

Figure 3:
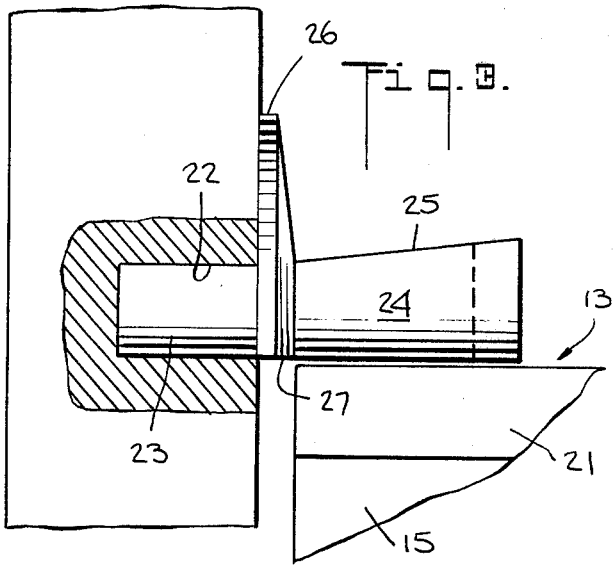
FIG. 3 is an enlarged fragmentary side elevational view showing the clip partially installed in the sidewall of the cabinet.

Referring to FIG. 1 there is shown, entirely by way of example, a china cabinet constructed of wood and having side panels 10 and 11, a bottom wall 12, and a stacked assembly of shelves 13 secured in place by a plurality of clips such as the one seen at 14.

As best seen in FIG. 2, three shelves 15, 16 and 17 are stacked one on top of the other on the bottom wall

12 of the cabinet with layers of corrugated paperboard 18, 19 and 20 interposed therebetween to provide cushioning. In the subject illustration, the shelves are shown made of wood or glass and the upper surface of the top shelf 15 in the stacked assembly is protected by a covering of cellulose wadding 21. The stacked assembly is anchored in place by a pair of clips installed in each of the side panels 10 and 11. As seen in FIG. 2 one clip 14 is already installed while the bore 22 in the side panel 10 is shown ready to receive a second clip. It will be observed that the bore 22 is substantially tangent to the upper surface of the stacked assembly 13.

Figure 4:
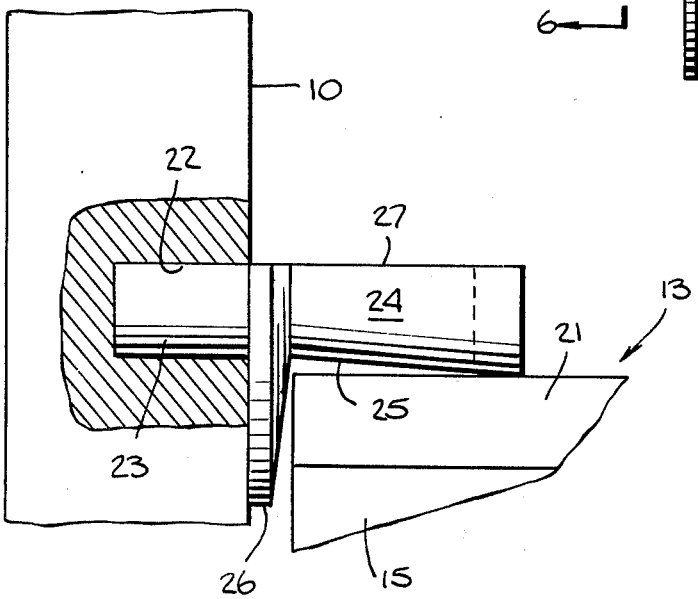
FIG. 4 is a view similar to FIG. 3 showing the orientation of the clip after complete installation thereof.
Figure 6:
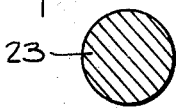
FIG. 6 is a cross-sectional view taken along the line 6—6 in FIG. 5.

The details of the clip 14 are shown in FIGS. 3 through 8, inclusive, it being understood that all of the other clips are identical thereto. FIG. 3 shows the clip in position for installation while FIG. 4 shows the clip in its fully installed locked position. The clip consists of an elongated body having at one end a cylindrical portion 23 for insertion in the bore, such as 22, in a side panel of the cabinet. At the other end of the body of the clip there is a camming portion 24 with a surface 25 on its side for exerting pressure as best seen in FIG. 4 against the adjacent surface of the stacked assembly of shelves 13. In addition, the clip includes a segment of an annular flange 26 disposed intermediate the ends of said body in a plane substantially normal to the longitudinal axis of the body for disposition, as best seen in FIG. 4, between the side panel, e.g., panel 10, and an end of at least one shelf, e.g., shelf 15.

The camming portion 24 and the flange 26 have a common substantially flat side 27 substantially co-planar with an element of the cylindrical portion 23 whereby the clip can be translated, as evident from FIG. 3, while positioned adjacent the upper surface of the stacked shelf assembly 13. That is, the clip may be placed with the flat side 27 down on the top of the stacked assembly and its cylindrical portion 23 pressed into the bore 22 which latter is dimensioned to make a sliding fit with the portion 23. Preferably, the bore in the side panel of the cabinet has a diameter approximately .010 inches greater than the diameter of the cylindrical portion 23 of the clip.

Figure 8:
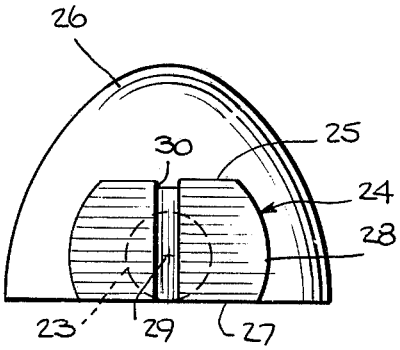
FIG. 8 is an end elevational view of the clip as seen looking toward the left in FIG. 3.
Figure 5:
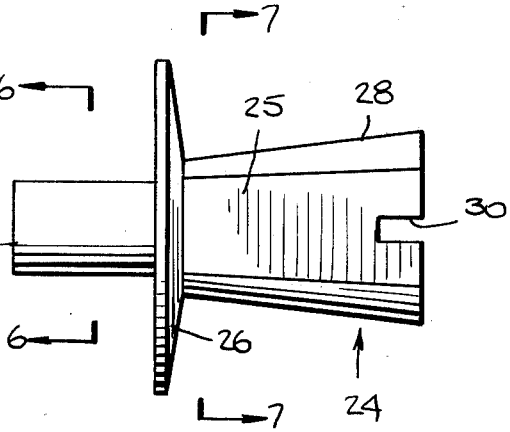
FIG. 5 is a top plan view of the clip.

As best seen in FIGS. 5 and 8, the camming portion 24 has a broadened region in the vicinity of 28 which is in a plane parallel to the flat side 27. It will be apparent from the ensuing description that said broadened region functions to resist rotation of the clip toward and away from said flat side 27. That is, it resists rotation when said clip is installed against a stacked assembly of shelves.

Figure 7:
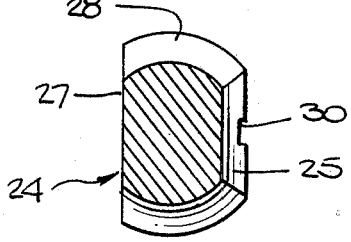
FIG. 7 is a cross-sectional view taken along the line 7—7 in FIG. 5.

As best seen in FIGS. 5, 7 and 8, the side surface 25 of the camming portion 24 is also flattened and lies opposite the flat side 27 but, at least at its extremity, radially more distant from the central axis 29 of the cylindrical portion 23 than the flat side 27.

As best seen in FIGS. 7 and 8, the broadened region 28 in the plane parallel to the flat side 27 has side surfaces which are rounded between the two flat surfaces 25 and 27.

A screwdriver slot 30 is formed in the end of the camming portion 24 for facilitating rotation of the clip about the central axis 29. That is, when the clip has been inserted to the position shown in FIG. 3, a screwdriver may be placed within the slot 30 and the clip rotated 180° into the position shown in FIG. 4. The configuration of the clip is such that the camming portion 24 develops additional downward pressure on the shelves 13 as the clip is rotated into final position. The clip preferably is formed from plastic and will be somewhat flexible such that the camming portion 24 bends upward slightly as viewed in FIG. 4 when fully installed.

Upon arrival of the cabinet at its final destination, a screwdriver may be inserted in the slot 30 and the clip rotated 180° back to the position shown in FIG. 3 whereupon it may be removed from the bore 22. The clips are sufficiently inexpensive that they may be discarded.

The generally tapered configuration of the camming portion is chosen both to provide adequate strength for said portion while, at the same time, affording adequate resistance to rotation away from the locked position of FIG. 4.

In a typical embodiment of the clip, the camming portion may have a length of about five-eighths inch, while the cylindrical portion has a length of about three-eighths inch. The diameter of the cylindrical portion may be approximately .240 inches to make a sliding fit within a one-fourth inch bore in a cabinet wall. As seen in FIG. 5, the camming portion may have a maximum width of about one-half inch tapering to a minimum width of about eleven thirty-seconds inch. As seen in FIG. 3, the maximum height of the camming portion may be approximately five-sixteenths inch while the minimum height adjacent the flange is about one-fourth inch. The flange may be about seven-eighths inch across its flat surface 27 and about five-eighths inch high at its peak.

Having described the details of the presently preferred embodiment of the subject invention, it will be understood by those skilled in the subject art that various changes in detail may be effected without departing from the true spirit of the invention as defined in the appended claims.

What is claimed is:

1. A clip for anchoring loose shelvs within a cabinet during shipping comprising an elongated body having at one end a cylindrical portion for insertion in a bore in a side panel of the cabinet, at the other end a camming portion with a surface on its side for exerting pressure against the adjacent surface of a stacked assembly of said shelves, and a segment of an annular flange disposed intermediate said ends of said body in a plane substantially normal to the longitudinal axis of said body for disposition between said side panel and an end of at least one shelf, said camming portion and said flange having a common substantially flat side substantially co-planar with an element of said cylindrical portion, said side surface of said camming portion being flattened and disposed opposite said flat side but, at least at its extremity, radially more distant from the central axis of said cylindrical portion than said flat side, and wherein said camming portion has rounded surface portions between said flat side and said flattened surface.

2. A clip according to claim 1, wherein said camming portion is provided with means for facilitating rotation about said longitudinal axis.

3. A clip according to claim 2, wherein said means comprises a screwdriver slot formed in the end of said camming portion.

4. A clip according to claim 1, wherein said camming portion has a broadened region adjacent said flat side for engaging said stacked assembly to resist rotation both toward and away from said flat side.

* * * * *